US010384114B2

(12) United States Patent
Fritz et al.

(10) Patent No.: US 10,384,114 B2
(45) Date of Patent: Aug. 20, 2019

(54) TRAINING APPARATUS AND SYSTEM WITH MUSICAL FEEDBACK

(75) Inventors: Thomas Fritz, Karlsruhe (DE); John Dylan Haynes, Berlin (DE); Carlo Crovato, London (GB)

(73) Assignee: Max-Planck-Gesellschaft zur Förderung der Wissenschaften e.V., Munich (DE)

( * ) Notice: Subject to any disclaimer, the term of this patent is extended or adjusted under 35 U.S.C. 154(b) by 0 days.

(21) Appl. No.: 13/699,675

(22) PCT Filed: May 26, 2011

(86) PCT No.: PCT/EP2011/058677

§ 371 (c)(1),
(2), (4) Date: Jan. 24, 2013

(87) PCT Pub. No.: WO2011/147934

PCT Pub. Date: Dec. 1, 2011

(65) Prior Publication Data

US 2013/0116091 A1 May 9, 2013

Related U.S. Application Data

(60) Provisional application No. 61/348,402, filed on May 26, 2010.

(30) Foreign Application Priority Data

May 26, 2010 (EP) ..... 10005458

(51) Int. Cl.
*A63B 24/00* (2006.01)
*A63B 71/00* (2006.01)
(Continued)

(52) U.S. Cl.
CPC ..... *A63B 71/0622* (2013.01); *A63B 21/06* (2013.01); *A63B 22/0056* (2013.01); *A63B 23/02* (2013.01);
(Continued)

(58) Field of Classification Search
CPC . A63B 21/225; A63B 22/001; A63B 24/0003; A63B 24/0021; A63B 24/00;
(Continued)

(56) References Cited

U.S. PATENT DOCUMENTS 4,705,268 A * 11/1987 Nadeau ..... A63B 22/0076 446/397
4,905,676 A * 3/1990 Bond ..... A63B 24/00 601/34
(Continued)

FOREIGN PATENT DOCUMENTS

FR 2 680 113 A3 2/1993
FR 2680113 2/1993
(Continued)

OTHER PUBLICATIONS

Fritz, T.H, et al. "Benefits of listening to a recording of euphoric joint music making in polydrug abusers," Frontiers in Human Neuroscience, Jun. 11, 2015, DOI=10.3389/fnhum.2015.00300, ISSN=1662-5161.
(Continued)

*Primary Examiner* — Sundhara M Ganesan
*Assistant Examiner* — Shila Jalalzadeh Abyaneh
(74) *Attorney, Agent, or Firm* — Siritzky Law, PLLC

(57) ABSTRACT

A training apparatus includes adjustable resistance means; means for continuously determining an actual configuration of the training apparatus during exercise; means for generating a control signal for an audio device, the control signal being at least partially based on the actual configuration of
(Continued)

the training apparatus; and means for outputting the control signal.

18 Claims, 8 Drawing Sheets

(51) Int. Cl.

| | |
|---|---|
| ***A63B 71/06*** | (2006.01) |
| *A63B 21/06* | (2006.01) |
| *A63B 22/00* | (2006.01) |
| *A63B 23/02* | (2006.01) |
| *G10H 1/00* | (2006.01) |
| *G10H 1/32* | (2006.01) |

(52) U.S. Cl.
CPC ..... *A63B 24/00* (2013.01); *A63B 2071/0625* (2013.01); *A63B 2220/10* (2013.01); *A63B 2225/105* (2013.01); *A63B 2225/20* (2013.01); *A63B 2225/50* (2013.01); *G10H 1/0066* (2013.01); *G10H 1/32* (2013.01); *G10H 2220/201* (2013.01); *G10H 2240/175* (2013.01); *G10H 2240/305* (2013.01)

(58) Field of Classification Search
CPC ..... A63B 71/0622; A63B 2225/20; A63B 2225/50; A63B 21/06; A63B 2071/0625; A63B 2220/10; A63B 2225/105; A63B 23/02; A63B 22/0056; A63B 2069/0055; G10H 1/0066; G10H 1/32; G10H 2240/305; G10H 2220/201; G10H 2240/175
USPC ..... 482/1, 4, 92–94, 98
See application file for complete search history.

(56) References Cited

U.S. PATENT DOCUMENTS

| | | | | |
|---|---|---|---|---|
| 4,998,725 | A * | 3/1991 | Watterson et al. | 482/6 |
| 5,137,501 | A * | 8/1992 | Mertesdorf | A63B 22/001 482/57 |
| 5,830,107 | A * | 11/1998 | Brigliadoro | A63B 23/03575 482/1 |
| 2003/0066413 | A1 | 4/2003 | Nishitani | |
| 2003/0171188 | A1* | 9/2003 | Neil | A63B 21/0628 482/8 |
| 2003/0216228 | A1 | 11/2003 | Rast | |
| 2006/0003872 | A1* | 1/2006 | Chiles | A63B 21/225 482/57 |
| 2006/0243120 | A1* | 11/2006 | Takai et al. | 84/612 |
| 2007/0044641 | A1 | 3/2007 | McKinney et al. | |
| 2007/0049470 | A1* | 3/2007 | Pyles | A63B 21/068 482/95 |
| 2007/0060446 | A1* | 3/2007 | Asukai | A63B 24/0021 482/8 |
| 2007/0213110 | A1* | 9/2007 | Rosenberg | A63B 71/0686 463/7 |
| 2007/0265138 | A1* | 11/2007 | Ashby | 482/8 |
| 2010/0075806 | A1* | 3/2010 | Montgomery | A63B 24/0003 482/8 |
| 2011/0172059 | A1* | 7/2011 | Watterson | A63B 22/02 482/5 |

FOREIGN PATENT DOCUMENTS

| | | | |
|---|---|---|---|
| GB | 2 414 195 | A | 11/2005 |
| GB | 2414195 | | 11/2005 |
| JP | 5 068723 | A | 3/1993 |
| JP | 5068723 | | 3/1993 |
| JP | 2008 279250 | A | 11/2008 |
| JP | 2008279250 | | 11/2008 |
| WO | WO 2005/120660 | | 12/2005 |
| WO | WO 2005/120660 | A1 | 12/2005 |

OTHER PUBLICATIONS

Fritz, T.H., et al. "Musical feedback during exercise machine workout enhances mood," Frontiers in Psychology, vol. 4, No. 921, Dec. 10, 2013, DOI=10.3389/fpsyg.2013.00921, ISSN=1664-1078.

Fritz, T.H, et al. "Musical agency reduces perceived exertion during strenuous physical performance," PNAS 2013 110 (44) 17784-17789, Oct. 29, 2013.

English abstract for FR 2680113, published Feb. 12, 1993, from EPO.

English abstract for JP 2008279250, published Nov. 20, 2008, from JPO.

English abstract for JP 5068723, published Mar. 23, 1993, from JPO.

EP Appln. No. 10005458.4—Dec. 17, 2010 European Search Report, European Patent Office.

International Search Report dated Sep. 23, 2011 in Internation Appln. No. PCT/EP2011/058677, WIPO.

* cited by examiner

TRAINING APPARATUS AND SYSTEM WITH MUSICAL FEEDBACK

CROSS-REFERENCE TO RELATED APPLICATIONS

This application is the National Phase of International Application PCT/EP2011/058677, filed May 26, 2011, which designated the U.S. and that International Application was published under PCT Article 21 (2) in English as WO 011/147934. This application also claims benefit of U.S. Provisional Application No. 61/348,402, filed May 26, 2010. The entire contents of PCT/EP2011/058677 and U.S. 61/348,402 are hereby fully incorporated by reference for all purposes.

The present invention relates to a training apparatus or fitness device for physical exercise having resistance means.

In the state of the art, a large variety of training apparatuses of this kind are known for training different muscles or muscle groups of the human body. However, they are usually characterized by a certain monotony and repetitiousness in their use. If a user has no intrinsic motivation to repeat a given exercise the necessary number of times, the use of the device quickly becomes boring.

Also, as the user focuses his attention on his interaction with the apparatus, he stays fully aware of his effort and strain, and his possible exhaustion. Further, the kind of movement required by fitness devices is uniform and predefined, leaving little room for the user to vary movements or the intensity of its use.

What is particularly lacking is an occasion or cause for varying use of the training apparatus or the training movements. In other words, the user often lacks a concrete adequate cause or incentive to engage in harmonic motoric movements.

Therefore, it is an object of the present invention to provide a training apparatus which increases the user's motivation to overcome physical exhaustion and to provide a greater motivation in using the device by providing a mechanism that guides the exercise in a more adequate way. It is a further object of the invention to provide a training apparatus that may be used by a group of people, thereby creating further incentives or motivations to exercise.

These objects are achieved by a training apparatus and a method for generating an audio signal according to the independent claims. Advantageous embodiments are defined in the dependent claims.

By playing music depending on the configuration of the training apparatus, the training apparatus is effectively turned into a music instrument.

The user's very strong motivation to vary the generated music or audio feedback signal leads to a finer and more varied interaction with the training apparatus, guided by musical principles, such has harmony, rhythm and variation. More particularly, by determining the configuration of the training apparatus continuously, the training apparatus according to the invention allows the user to control the musical experience by performing fine movements, such as changes in direction, small shifts, etc, in line with a desired musical dynamics. These movements are rather atypical when using a training apparatus according to the state of the art, but emerge naturally when using the present invention. This experience is increased when also the control signal is generated continuously, i.e. when gradual movements are translated into gradual changes in the musical signal.

Most importantly, the invention does not set out to guide the user but to provide him with a means to explore a continuum of possible soundscapes by actuating the training apparatus.

Further aspects and advantages of the present invention will become apparent to the skilled person when studying the following description of a preferred embodiment of the present invention, in connection with the drawings, in which FIG. 1 is a schematic diagram of a training apparatus according to a preferred embodiment of the invention; and FIG. 2 shows an embodiment of a step training apparatus according to the invention.

Figure 1:
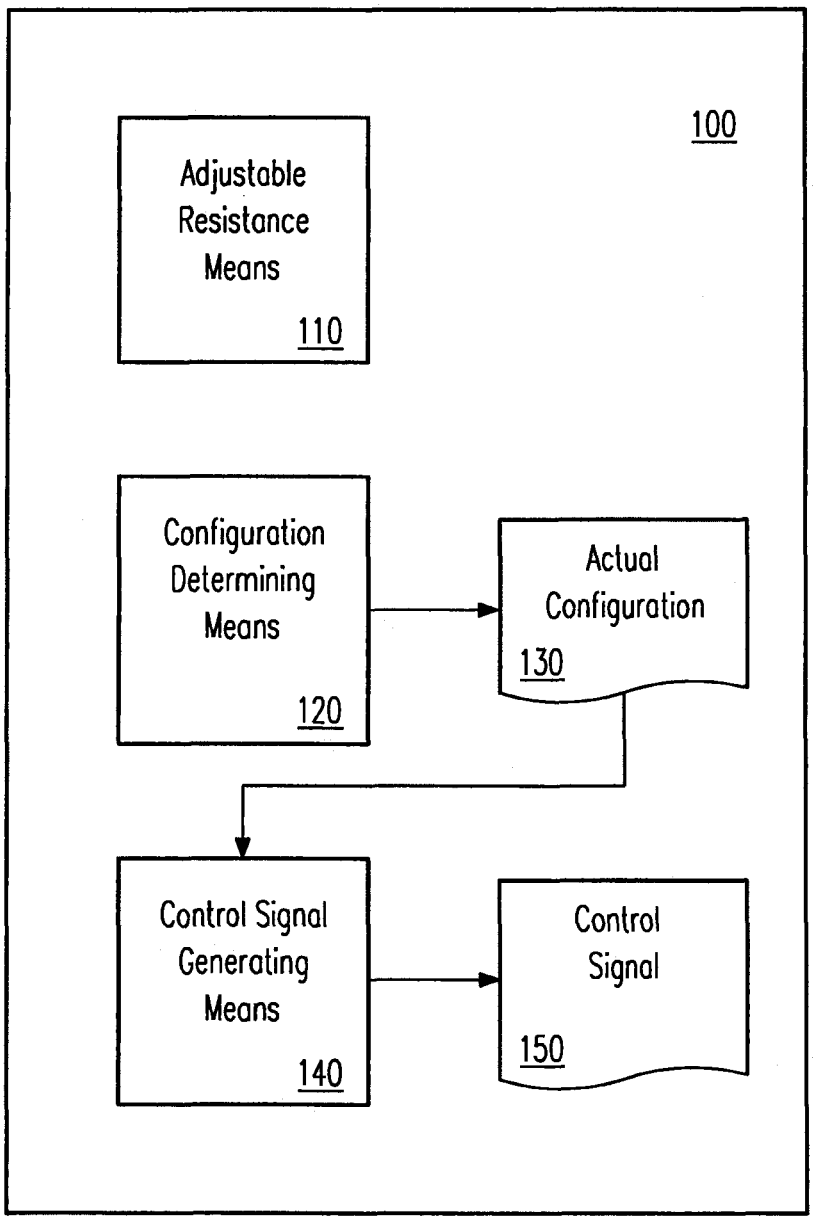
FIG. 1 is a schematic block diagram of a training apparatus 100 according to a preferred embodiment of the invention.

The training apparatus comprises resistance means 110.

Examples of such training apparatuses include, without limitation, weight machines, friction machines, spring-loaded machines, fan-loaded machines, fluid-loaded machines and/or hydraulic machines.

The resistance means are adjustable. Preferably, the resistance of the adjustable resistance means may be adjusted to be greater than 25 Newton (N). Preferably, it may be adjusted to be greater than 100 Newton (N) or greater than 250 Newton (N).

The adjustable resistance may be incremented either continually or discretely. In the discrete case, adjustments are preferably possible in increments of approximately 25 or approximately 50 Newton (N).

The training apparatus further comprises means 120 for continuously determining an actual configuration 130 of the training apparatus during exercise.

An actual configuration 130 of the apparatus may comprise a single or several parameters, such as a variable position of a weight as it is lifted during an exercise. Alternatively, it may comprise, without limitation, a variable position of a pulley, lever, wheel or incline of the training apparatus that are actioned or operated by a user as he exercises. The different configurations of the apparatus may vary continuously or discretely. For the purposes of the present invention, an actual configuration may also comprise an instantaneous speed by which a wheel of a resistance means actually turns, e.g. on a spinning bike.

For determining the configuration 130, a position transducing means such as a potentiometer may be used for determining the position of a weight or the inclination of a lever. Preferably, a digital potentiometer may be used. Current speed determining means for the wheel may include a speedometer or a tachometer.

The apparatus 100 further comprises means 140 for generating a control signal 150 for controlling an audio device, the control signal 150 being at least partially based on the actual configuration of the training apparatus 130. The control signal may be any kind of control signal for controlling an audio device, either in digital or analog form. For example, the control signal may be a changing current or voltage. The control signal may cause an audio device to reproduce a piece of recorded music or to generate a sequence of sounds or distinct notes. The control signal may also cause the audio device to modify a piece of recorded music before reproduction. In a preferred embodiment, the control signal is a MIDI signal for controlling a MIDI audio device. Preferably, the control signal is also generated continuously.

For this purpose, the generating means 140 may process the configuration 130 in analog form or in digital form, as it is provided by determining means 120.

Finally, the apparatus 100 comprises means for outputting the generated control signal 150 to an audio device (not shown in FIG. 1). In case of a MIDI signal, the outputting means is a MIDI (OUT) jack.

Optionally, the audio feedback signal 150 may also be output to a recorder (not shown) for storing the signal in or on a machine-readable medium (also not shown). Recorded signals may be used in order to create loops continuously repeating the recorded signal.

The training apparatus according to the invention may advantageously be used in the rehabilitation of physically impaired patients, e.g. stroke patients.

The invention further comprises an extension kit for training apparatuses, comprising means for determining an actual configuration of the training apparatus during exercise; means for generating an audio feedback signal, the audio feedback signal being at least partially based on the actual configuration of the training apparatus; and means for outputting the audio feedback signal.

Using the extension kit, existing training devices may be supplemented with an ability to generate audio feedback signals according to the invention.

Figure 2:
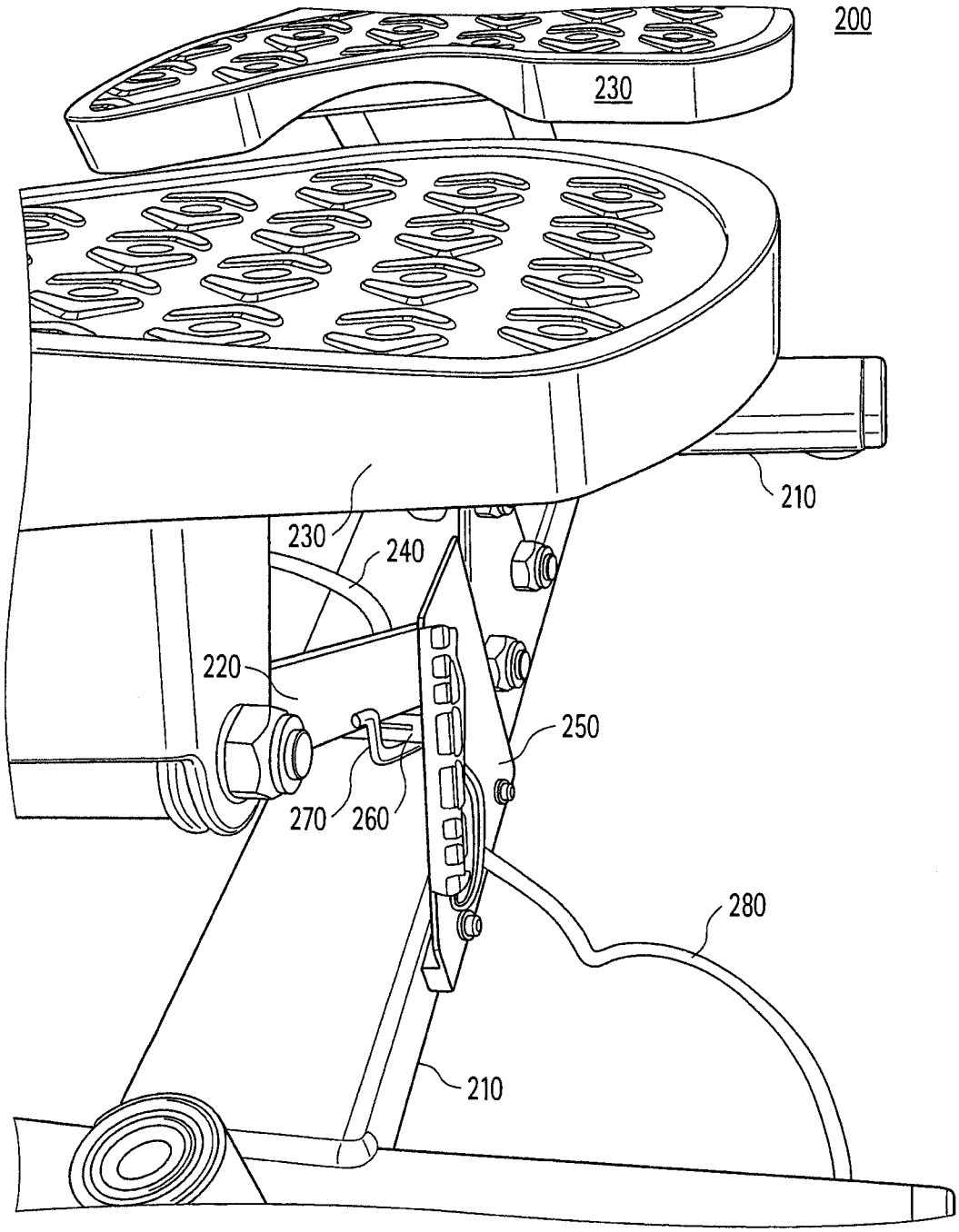

FIG. 2 shows an embodiment of a step training apparatus (stepper) 200 according to the invention.

The stepper 200 comprises a foot 210, on which are mounted two levers 220. Mounted on each lever 220 are stepping platforms 230 on each of which a user steps with one foot. If the user shifts his weight to one platform 230, i.e. to one lever 220, this lever 220 moves downwards. At the same time, the other lever that is not loaded by the user's weight moves upwards.

Each lever 220 comprises adjustable resistance means 240. The speed of moving downwards depends on the user's weight and on the adjustable resistance means 240 forming part of the lever. If a high resistance is chosen, the loaded lever moves down rather slowly. The lower the resistance, the faster a lever moves. Moreover, the resistance means 240 restores the lever 220 to its original position whenever it is unloaded.

The stepper 200 further comprises a potentiometer 250 in order to determine the position of at least one lever 220. More particularly, one lever 220 comprises a holding bracket 270 in which a wiper 260 of the potentiometer 250 is inserted, such that the bracket 270 moves the wiper 260 substantially whenever the lever 220 moves. In the present example, the position of the wiper 260 changes linearly with the position of the lever.

Based on the position of the wiper, the potentiometer 250 generates a current that changes with the position of the lever 220 and is output through a connection cable 280.

Figure 3:
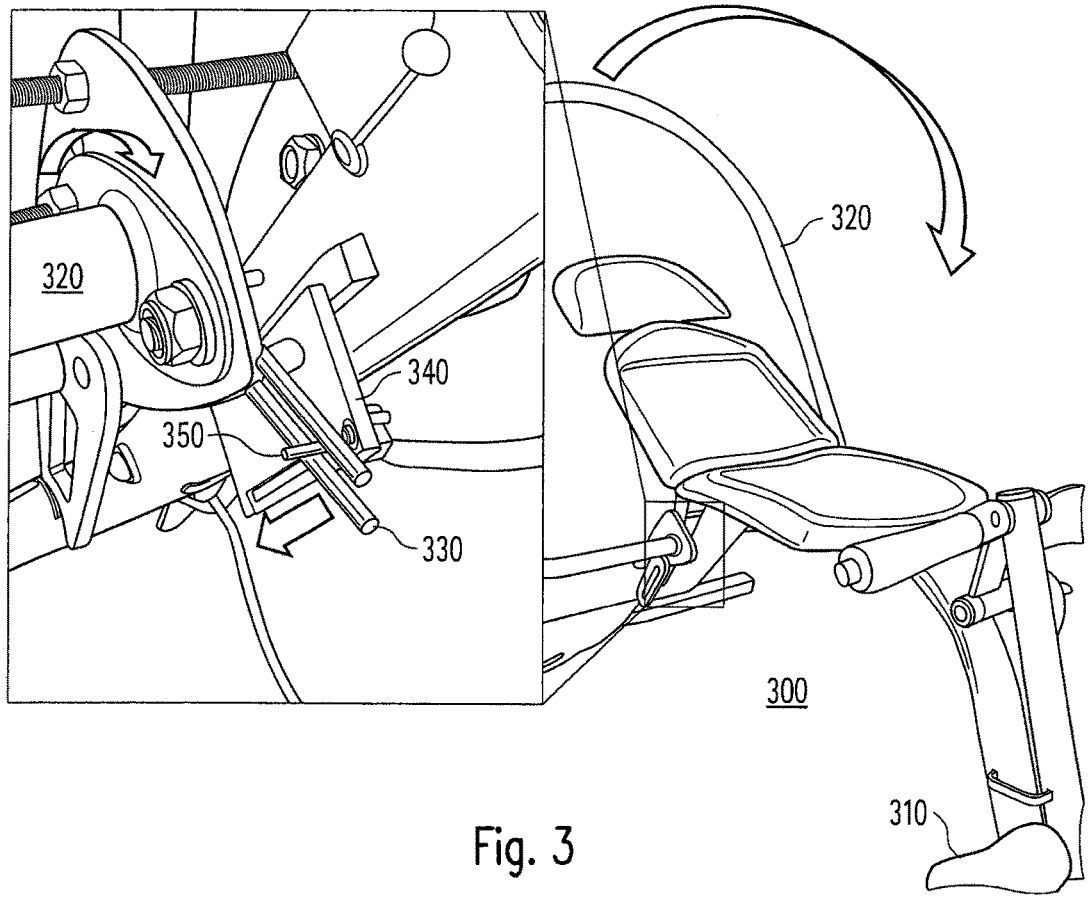
FIG. 3 shows a further embodiment of a training apparatus for the abdominal muscles according to the invention.

FIG. 3 shows a further embodiment of a training apparatus 300 for the abdominal muscles according to the invention.

The training apparatus 300 comprises a bench 310 and a handle 320 in the form of an arch. The handle 320 is pivotally mounted to the bench 310. During exercise, a user lies or sits on the bench 310 and moves the handle 320 forwards with his hands as indicated by the arrow.

The handle comprises an adjustable resistance (not shown) that restores the handle to its original position when the user releases it.

As shown in the cut-out of FIG. 3 on the left-hand side, the handle 320 rotates in the direction indicated by the small arrow. In order to determine the position of the handle, the handle 300 further comprises a bracket 330 that rotates with the handle and moves a wiper 350 of a potentiometer 340. As in the previous example, the position of the wiper 350 changes linearly with the rotation angle (position) of the handle.

Optionally, the apparatus according to FIG. 3 may further comprise a second resistance means that the user may actuate with his legs or feet and that is also equipped with a means for determining the configuration of the second resistance means, wherein the determined configurations of the two resistance means may be combined to form the control signal, such that the training apparatus may be "played" in two dimensions.

Figure 4:
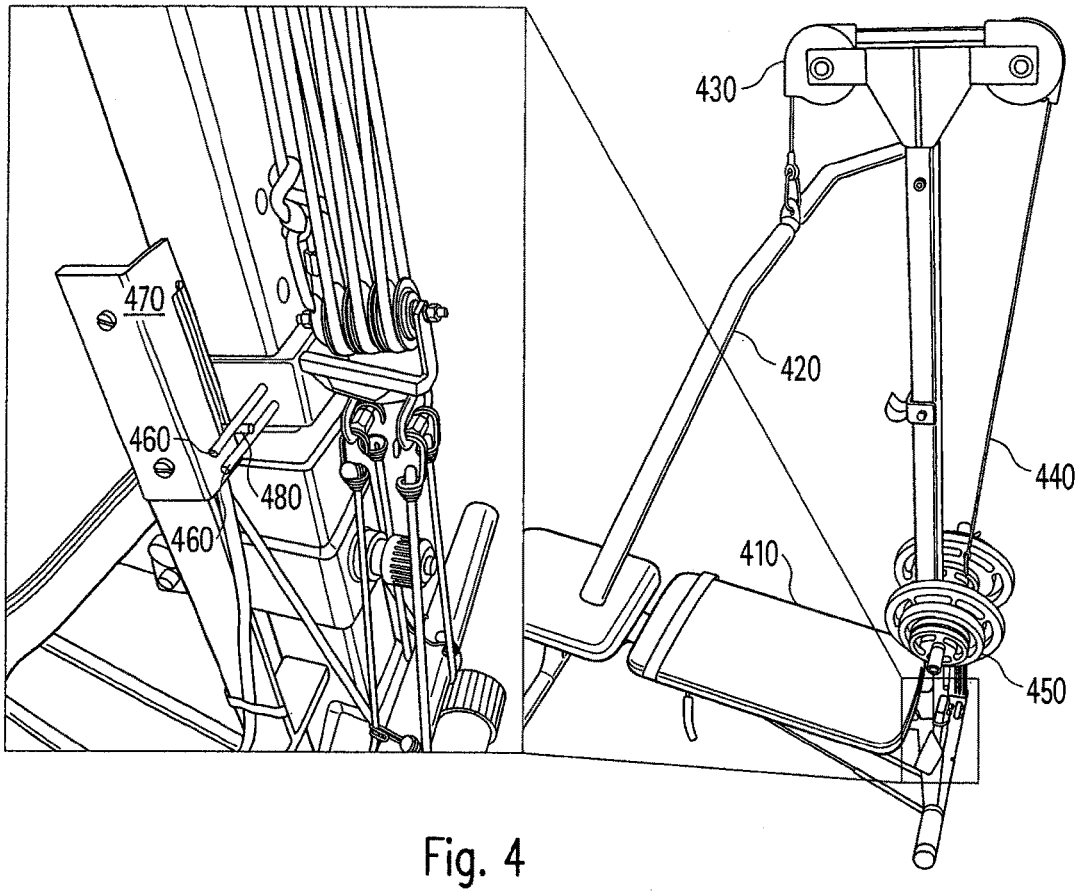
FIG. 4 shows another embodiment of a training apparatus for the upper body and arm muscles according to the invention.

FIG. 4 shows yet another embodiment of a training apparatus for the upper body and arm muscles according to the invention.

The training apparatus comprises a bench 410, a handle 420, pulleys 430, a cable 440 and an adjustable weight 450. During exercise, a user sits on the bench and pulls the handle down towards himself. As the user pulls down the handle, the weight moves upwards.

In order to determine the position of the weight, the training apparatus further comprises a bracket 460 that moves in line with the weight and engages a wiper 480 of a potentiometer 470 installed in the training apparatus. Again, the position of the wiper 480 changes linearly with the position of the weight.

Figure 5:
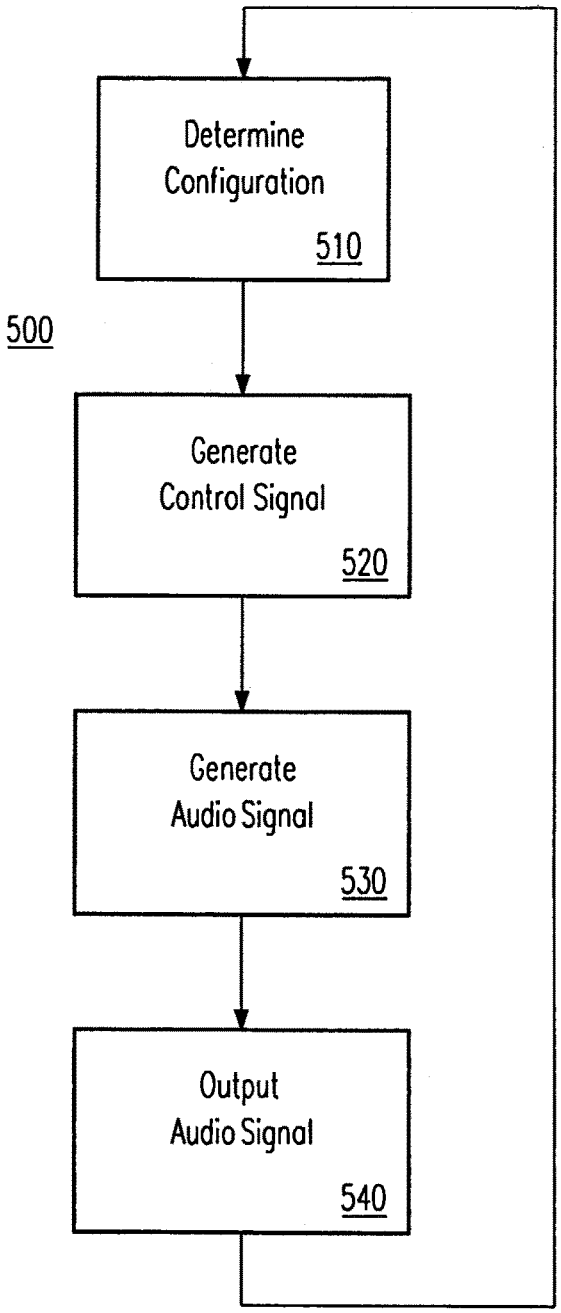
FIG. 5 is a flowchart of a method for operating a training apparatus according to the invention.

FIG. 5 is a flowchart of a method 500 for operating a training apparatus having adjustable resistance means.

In step 510, an actual configuration of the training apparatus is continuously determined during exercise. The actual configuration may comprise an actual position of the resistance means.

In step 520, a control signal for controlling an audio device is generated, the control signal being at least partially based on the actual configuration of the training apparatus. Preferably, the control signal is also generated continuously. In particular, the control signal may be a MIDI signal.

In step 530, an audio signal is generated, the audio signal being at least partially based on the control signal.

An audio signal is a representation of sound waves, typically in the form of an electrical voltage, but also through alternative mediums such as magnetic particles, when recorded onto analogue tape; or as radio frequency waves, when broadcast through radio; or even as pulses of light, when transmitting through fiber optic cables like TOSLINK. An audio signal can be manipulated, stored, transmitted and reproduced in ways that a sound wave cannot.

Advantageously, a volume, or a pitch, or a tempo of the audio signal may depend at least partially on the actual position of the adjustable resistance means. More particularly, the volume, or the pitch, or the tempo of the audio feedback signal may be linear-proportional to the actual position of the adjustable resistance means. Alternatively, the relationship may also be set to be non-linear, e.g. by using a band-pass filter, because the user of the apparatus will be able to pick up non-linear relationships after a while. The challenge to do so may further increase the motivation to use the apparatus.

Optionally, the audio signal may comprise different tracks. Further, the user may select different instruments for the generation of the audio signal, e.g. a drum or a piano. Tracks for different instruments may also be merged in one audio signal, for example when several users exercise together.

As a further option, the choice of the audio signal may depend on the magnitude of the resistance, as set by the user.

The audio signal may comprise a prerecorded audio sequence that may be output as the user exercises. This sequence may be merged with the audio feedback signal generated by the user, as he exercises.

Optionally, the user may record the acoustic sequence generated during his own exercise by himself in permanent form and replay it while going on to a different training apparatus.

Finally, the audio feedback signal generated by the user may be merged with audio feedback signals generated by users of other training apparatuses, e.g. when they exercise in concert.

In step 540, the audio signal is output by the audio device.

Figure 6:
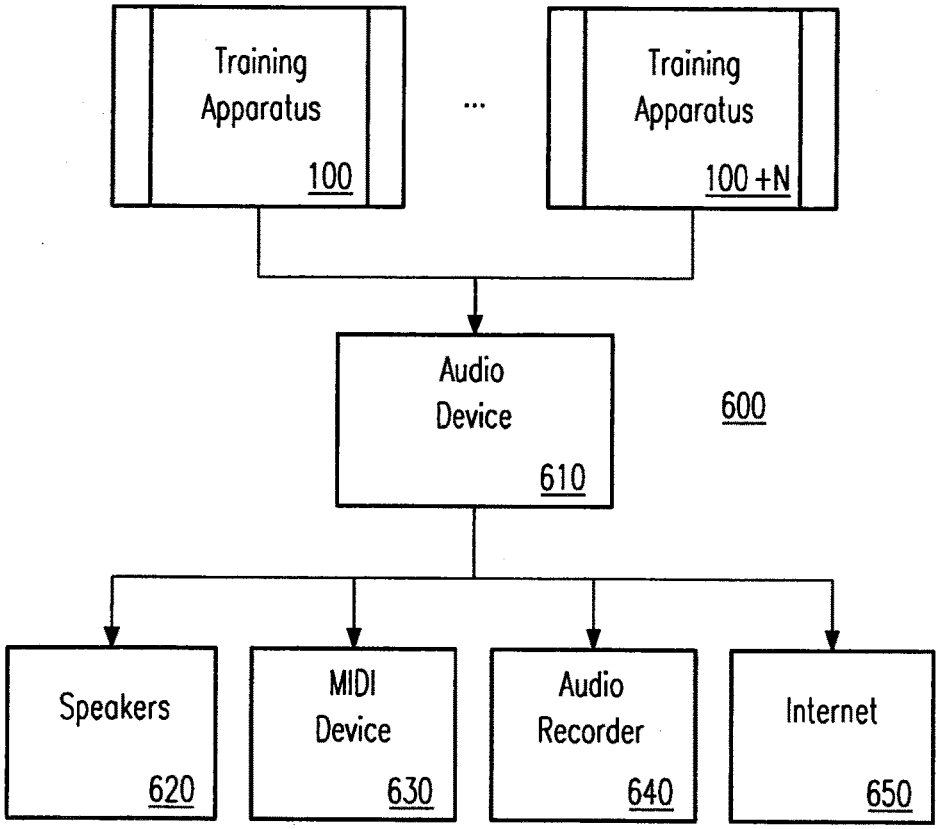
FIG. 6 is a schematic overview of a training system with acoustic feedback according to the invention.

FIG. 6 is a schematic overview of a training system with acoustic feedback according to an embodiment of the invention.

The training system comprises at least one training apparatus 100 as previously described, an audio device 610 for generating an audio signal and one or several output devices, e.g. loudspeakers and/or headphones 620, a MIDI device 630 or an audio recording device 640 to which the audio signal may be output simultaneously.

The training system operates as described in connection with FIG. 5.

If several training apparatuses are linked together as shown in FIG. 6, the users effectively exercise in concert.

The invention also comprises streaming an audio stream generated by use of the training system to the Internet, such that users at different locations may exercise together.

By using the described system, the musical feedback creates for the user or a group of users an experience of playing a song when using the training apparatus rather than actually exercising.

Figure 7:
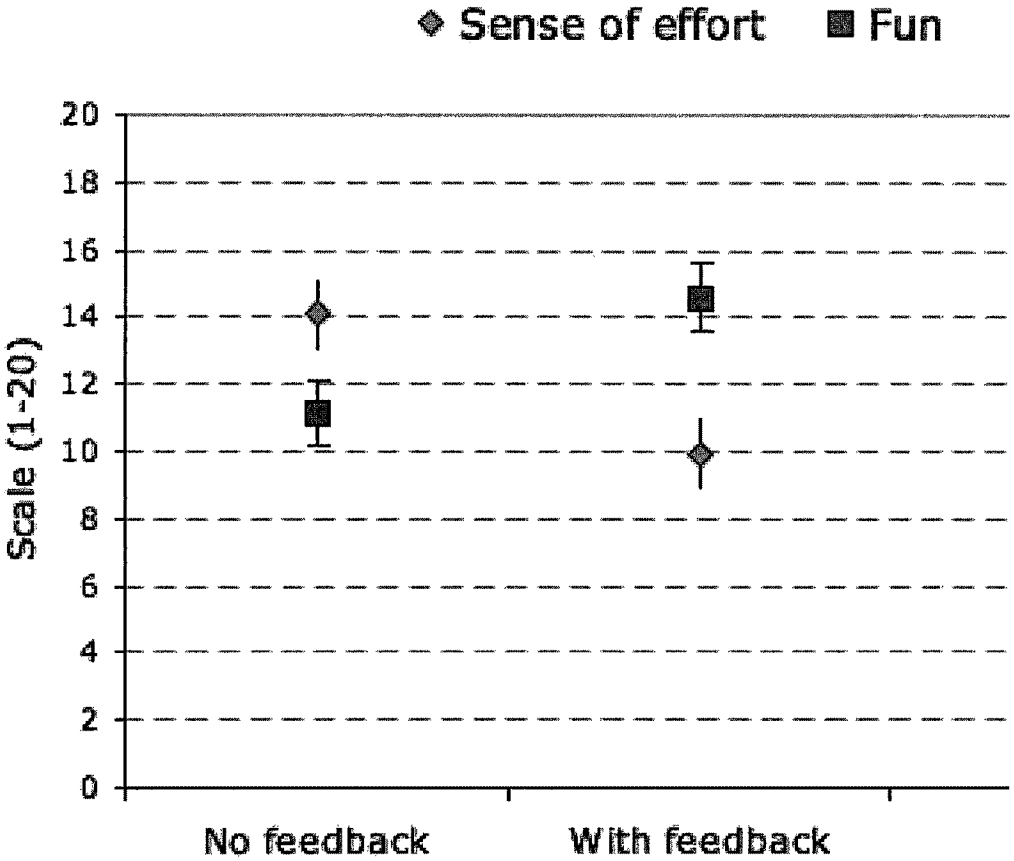
FIG. 7 depicts results from a behavioral study with fitness training with or without musical feedback (30 participants). It shows that with musical feedback the sense of effort was lower and the fun was higher compared with usual fitness training.

FIG. 7 depicts results from a behavioral study with fitness training with or without musical feedback (30 participants). It shows that with musical feedback the sense of effort was lower and the fun was higher compared with usual fitness training.

Figure 8:
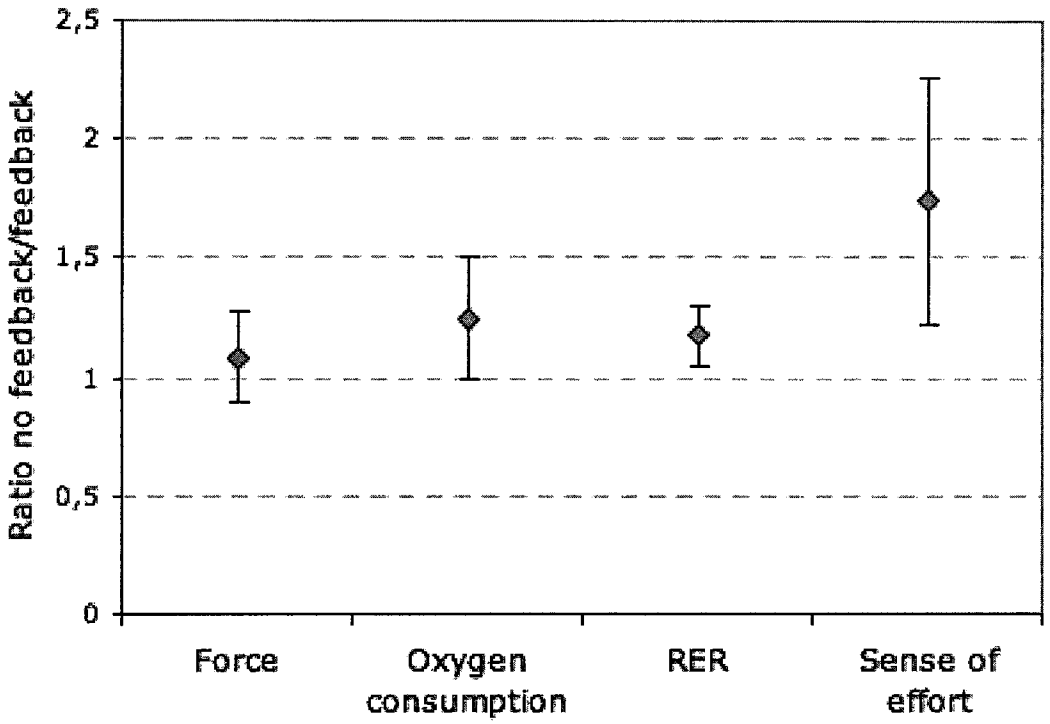
FIG. 8 shows measured force, metabolism (Oxygen consumption and RER as measured with a Spirometer), and Sense of effort as a ratio of no feedback/feedback (N=10).

FIG. 8 shows measured force, metabolism (Oxygen consumption and RER as measured with a Spirometer), and Sense of effort as a ratio of no feedback/feedback (N=10).

The force and metabolism is quite comparable between the conditions. It is slightly higher without feedback where participants would rather go into anaerobic metabolism, (RER>1), which from a sport physiological point of view is not good. Note that the sense of effort with a mean value of 1.75 is much higher than the difference in metabolism between the conditions, showing that it is unproportionally to the work which has been done higher without musical feedback (or unproportionally lower with musical feedback). This demonstrates that the explored method of musical feedback during workout decreased the sense of effort invested in the workout.

The invention claimed is:

1. A training apparatus comprising:

an adjustable resistance means;

a position transducer configured to continuously determine an actual configuration of the training apparatus during exercise, wherein said actual configuration of the training apparatus during exercise comprises a variable position of the adjustable resistance means that is caused by a user as said user exercises and as a result of the user's exercising;

a control signal generator constructed and configured to generate a control signal to control an audio device, the control signal being at least partially based on the position of the adjustable resistance means, wherein the control signal comprises a continuously generated signal; and means for outputting the control signal, wherein the control signal controls a volume, a pitch, or a tempo of an audio signal generated by the audio device, wherein the training apparatus is one of a weight machine, a friction machine, a spring-loaded machine, a fan-loaded machine, a fluid-loaded machine, or a hydraulic machine, and wherein the audio signal is merged with one or more audio feedback signals generated by a corresponding one or more other training apparatuses.

2. The training apparatus of claim 1, wherein the audio signal comprises different tracks.

3. The training apparatus of claim 2, wherein the tracks comprise a drum track.

4. The training apparatus of claim 2, wherein the tracks comprise a piano track.

5. The training apparatus according to claim 1, wherein a resistance of the adjustable resistance means is adjustable to be greater than 25 Newton (N).

6. The training apparatus according to claim 1, wherein the training apparatus is configured for rehabilitation of physically impaired patients.

7. The training apparatus of claim 1, wherein the position transducer comprises a potentiometer.

8. The training apparatus of claim 1, wherein different instruments can be selected by the user for generation of the audio signal.

9. The training apparatus of claim 1, wherein a choice of the audio signal depends on a magnitude of a resistance of the adjustable resistance means.

10. The training apparatus of claim 1, wherein the volume, the pitch or the tempo of the audio signal is linearly-proportional to the actual position of the adjustable resistance means.

11. A method for generating an acoustic feedback during a physical exercise of a user on a training apparatus, the method comprising:

providing a training apparatus comprising an adjustable resistance means;

continuously determining an actual configuration of the training apparatus during exercise, wherein said actual configuration of the training apparatus during exercise comprises a variable position of the adjustable resistance means of the training apparatus that is caused by a user as said user exercises and as a result of the user's exercising;

generating a control signal configured to control an audio device, the control signal being at least partially based on the position of the adjustable resistance means, wherein the control signal comprises a continuously generated signal;

generating a first audio signal, the first audio signal being at least partially based on the generated control signal, wherein the control signal controls a volume, a pitch, or a tempo of the first audio signal generated by the audio device; and outputting the first audio signal, wherein the first audio signal generated by the audio device is merged with a second audio signal before it is output, wherein the second audio signal is an audio signal generated by at least one other training apparatus, and wherein the training apparatus is one of a weight machine, a friction machine, a spring-loaded machine, a fan-loaded machine, a fluid-loaded machine, or a hydraulic machine.

12. The method of claim 11, wherein the first audio signal comprises different tracks.

13. The method of claim 12, wherein the tracks comprise a drum track.

14. The method of claim 12, wherein the tracks comprise a piano track.

15. The method of claim 11, wherein the volume, or the pitch, or the tempo of the audio signal is linearly-proportional to the actual position of the adjustable resistance means.

16. The method of claim 11, further comprising:

selecting an instrument for generation of the first audio signal.

17. The method of claim 11, configured for rehabilitation of physically impaired patients.

18. A training system with acoustic feedback, the training system, comprising:

(A) an audio device configured to generate an audio signal;

(B) outputting means for outputting the audio signal; and (C) at least one training apparatus comprising:

(C)(1) an adjustable resistance means;

(C)(2) a position transducer configured to continuously determine an actual configuration of the at least one training apparatus during exercise, wherein said actual configuration of the at least one training apparatus during exercise comprises a variable position of the adjustable resistance means that is caused by a user as said user exercises and as a result of the user's exercising;

(C)(3) a control signal generator constructed and configured to generate a control signal to control said audio device, the control signal being at least partially based on the position of the adjustable resistance means, wherein the control signal comprises a continuously generated signal; and (C)(4) means for outputting the control signal, wherein the control signal controls a volume, a pitch, or a tempo of the audio signal generated by the audio device, and wherein the at least one training apparatus is one of a weight machine, a friction machine, a spring-loaded machine, a fan-loaded machine, a fluid-loaded machine, or a hydraulic machine, and wherein said at least one training apparatus comprises multiple training apparatuses, and wherein the audio signal output by the audio device is formed by merging audio signals generated by each of said multiple training apparatuses.

* * * * *